US008408166B1

(12) United States Patent
Zhou et al.

(10) Patent No.: US 8,408,166 B1
(45) Date of Patent: Apr. 2, 2013

(54) SYSTEM WITH A HEAT PIPE

(75) Inventors: Shiguang Zhou, Ann Arbor, MI (US); Eva Barber, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/584,297

(22) Filed: Aug. 13, 2012

(51) Int. Cl.
*F01P 1/04* (2006.01)

(52) U.S. Cl. ..... 123/41.35; 123/41.34; 123/196 R; 123/41.36

(58) Field of Classification Search ..... 123/41.34, 123/41.35, 41.36, 196 R
See application file for complete search history.

(56) References Cited

U.S. PATENT DOCUMENTS

| | | | | |
|---|---|---|---|---|
| 4,114,571 | A * | 9/1978 | Ruf | 123/41.35 |
| 4,493,292 | A * | 1/1985 | Showalter | 123/41.2 |
| 4,542,719 | A | 9/1985 | Wilkinson | |
| 4,667,630 | A * | 5/1987 | Sasaki | 123/254 |
| 5,220,892 | A | 6/1993 | Boemer | |
| 5,454,351 | A | 10/1995 | Cao et al. | |
| 6,694,930 | B2 | 2/2004 | Berlinger et al. | |
| 7,082,906 | B2 | 8/2006 | Jones et al. | |
| 7,603,977 | B2 | 10/2009 | Heidrich et al. | |
| 2006/0207543 | A1 | 9/2006 | Rehr | |
| 2012/0138010 | A1 | 6/2012 | Ulrey et al. | |

OTHER PUBLICATIONS

Cao, Yiding et al., "Thermal Analysis of a Piston Cooling System with Reciprocating Heat Pipes," Heat Transfer Engineering, vol. 16, No. 2, 1995, pp. 50-57.

Leriche, Maryline et al., "An Experimental and Analytical Study of a Variable Conductance Heat Pipe: Application to Vehicle Thermal Management," Applied Thermal Engineering, vol. 38, 2012, pp. 48-57.

* cited by examiner

*Primary Examiner* — Noah Kamen
*Assistant Examiner* — Hung Q Nguyen
(74) *Attorney, Agent, or Firm* — Julie Voutyras; Alleman Hall McCoy Russell & Tuttle LLP

(57) ABSTRACT

A system in an engine is provided. The system includes a piston spraying conduit including an inlet in fluidic communication with an oil reservoir, a nozzle in fluidic communication with the piston spraying conduit, the nozzle directing an oil spray toward an exterior surface of a piston positioned within a combustion chamber, and a heat pipe transferring heat from an evaporator section to the condenser section, the evaporator section coupled to the piston spraying conduit. In this way, more effective piston cooling is provided while maintaining lubrication effectiveness.

21 Claims, 2 Drawing Sheets

SYSTEM WITH A HEAT PIPE

BACKGROUND/SUMMARY

Combustion performance in a cylinder may be affected by many factors, including spark timing and compression ratio. To increase the power output of the engine, aggressive spark timing and high compression ratios may be used. However, the aggressive spark timing and the high compression ratios may drastically increase the temperature of the cylinder. The elevated temperatures may lead to increased emissions from the engine and in particular increased generation of nitrogen oxides (e.g., NOx). Knocking may also occur when the cylinder is at an elevated temperature. Moreover, thermal degradation (e.g., warping) of the engine components may occur due to the elevated temperatures. Therefore, the spark timing and compression ratio may be limited by the temperature of the combustion chamber, such as during peak loads.

US 2006/0207543 discloses an engine lubrication system which includes a spraying nozzle for directing engine oil toward the underside of the pistons. The oil spray may reduce the temperature of the piston and therefore the combustion chamber. The lubrication system discloses in US 2006/0207543 also includes an oil cooler for removing heat from the oil.

However, the Inventors herein have recognized that only a portion of the engine oil may be used to cool the pistons and the remainder may be used for component lubrication. It may be undesirable to cool oil used to lubricate components. For example, decreasing the temperature of the oil used for lubrication may increase oil viscosity above a desired valve, thereby increasing friction losses in the engine. Therefore, cooling all of the oil circulating in the lubrication system may increase fuel usage, as well as engine wear. Furthermore, during peak loads, oil coolers using engine coolant may not provide a desirable amount of cooling to the oil sprayed onto the pistons, due to the elevated temperature of the coolant. For example, oil coolers using engine coolant may not be able to decrease the temperature of the oil under a threshold temperature (e.g., 220° F. in some engines) needed to reduce thermal degradation in the combustion chamber.

As such in one approach, a system in an engine is provided. The system may include a piston spraying conduit including an inlet in fluidic communication with an oil reservoir, a nozzle in fluidic communication with the piston spraying conduit, the nozzle directing an oil spray toward an exterior surface of a piston positioned within a combustion chamber, and a heat pipe transferring heat from an evaporator section to a condenser section, the evaporator section coupled to the piston spraying conduit.

In this way, heat may be strategically removed from the engine oil directed at the piston. As a result, cooling may be provided to a desired portion of the engine oil without cooling the engine oil used to lubricate engine components, if desired. For instance, a heat exchanger may not be included in an engine lubrication system in the engine, in some embodiments. Moreover, the heat pipe enables heat to be passively removed from the oil without the use of a controller, if desired. Additionally, providing cooling to the piston via the heat pipe lowers the temperature of the combustion chamber, enabling higher compression ratios and more aggressive spark timing strategies. As a result, the power output of the engine is increased.

The above advantages and other advantages, and features of the present description will be readily apparent from the following Detailed Description when taken alone or in connection with the accompanying drawings. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

A system providing cooling to a piston cooling jet is provided herein. The system includes a heat pipe coupled to a piston spraying conduit arranged downstream of an oil pump in fluidic communication with an engine. The heat pipe enables heat to be removed from a targeted portion of the oil (i.e., the oil directed to the piston cooling jet). As a result, cooling other portions of the oil in a lubrication system may be avoided, if desired. For example, in one embodiment only a portion of the oil, e.g., the oil for spraying the pistons is cooled in this way, and thus not all of the oil passes through the cooling section.

Moreover, the heat pipe reduces the temperature of the oil directed at the piston, thereby reducing the temperature of the piston and combustion chamber. Additionally, providing cooling to the piston via the heat pipe lowers the temperature of the combustion chamber, enabling high compression ratios and more aggressive spark timing strategies to be used in the engine. As a result, the power output of the engine is increased.

Figure 1:
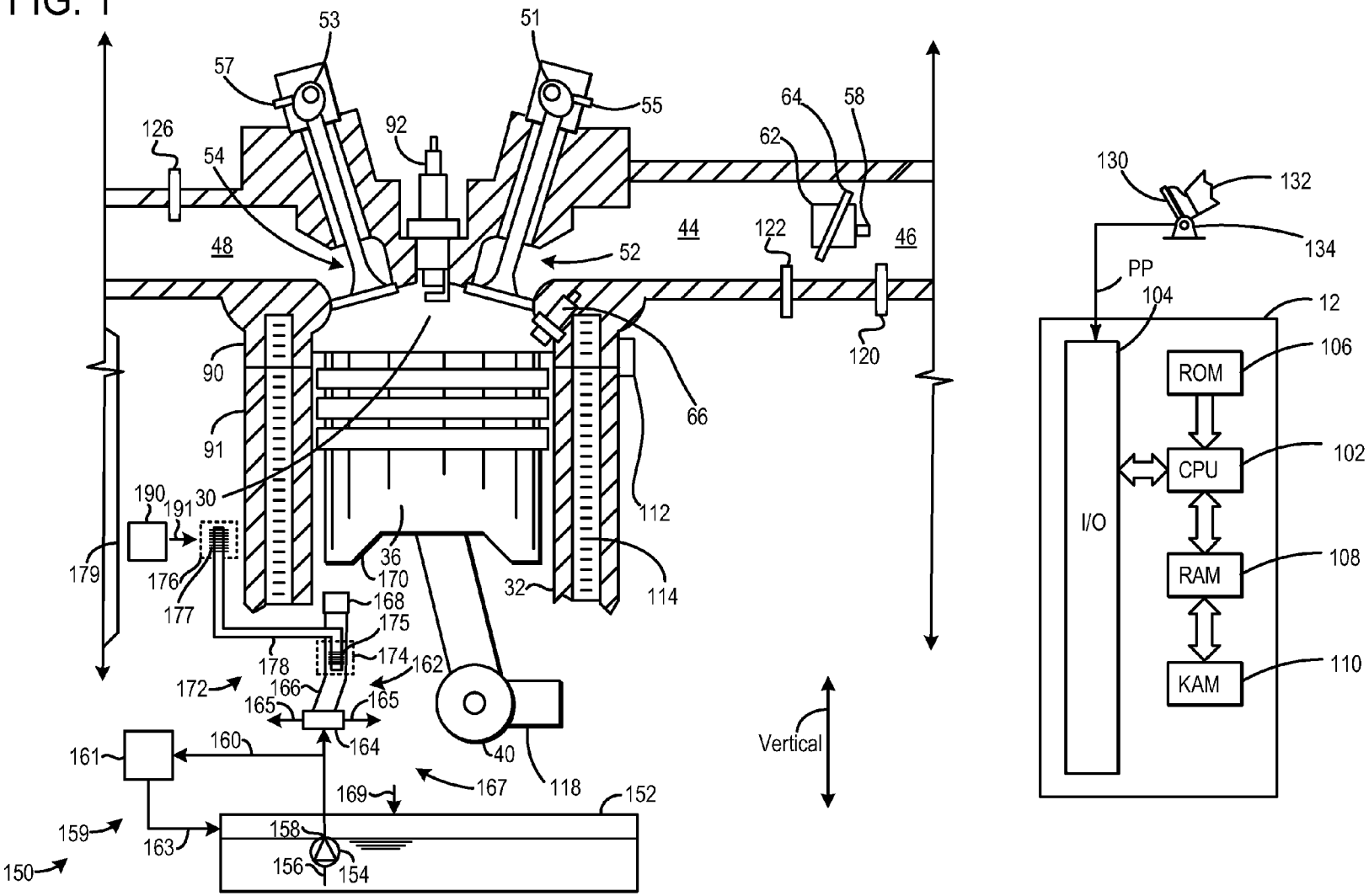
FIG. 1 shows a schematic depiction of an internal combustion engine including a heat pipe coupled to piston spraying conduit.

Referring to FIG. 1, internal combustion engine 10, comprising a plurality of cylinders, one cylinder of which is shown in FIG. 1, is controlled by electronic engine controller 12. The engine may be included in vehicle. Engine 10 includes combustion chamber 30 and combustion chamber walls 32 with piston 36 positioned therein and connected to a crankshaft 40. The combustion chamber 30 may have a compression ratio greater than 10, between 10 and 12, or between 9 and 12. The high compression ratio may be used due to the increased piston cooling provided by the piston cooling system 150, described in greater detail herein. In this way, the power output of the engine 10 may be increased.

The engine 10 also includes a cylinder head 90 coupled to a cylinder block 91 to form the combustion chamber 30. Therefore, the cylinder block 91 forms a portion of the combustion chamber 30. The cylinder block 91 may also be coupled to an oil reservoir 152 (e.g., sump), discussed in greater detail herein. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. In this way, the valves may be cyclically actuated to perform combustion in the combustion chamber 30. However, in other examples the valves may be electromagnetically actuated via electromagnetic valve actuators.

Fuel injector 66 is shown positioned to inject fuel directly into combustion chamber 30, which is known to those skilled in the art as direct injection. Additionally or alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from intake chamber 46. In other examples, the engine 10 may include a turbocharger having a compressor positioned in the induction system and a turbine positioned in the exhaust system. The turbine may be coupled to the compressor via a shaft. A high pressure, dual stage, fuel system may be used to generate higher fuel pressures at injector 66.

Distributorless ignition system 88 provides an ignition spark to combustion chamber 30 via spark plug 92 in response to controller 12. However, in other examples the ignition system 88 may not be included in the engine 10 and compression ignition may be utilized. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

A converter or other suitable emission control device may be positioned downstream of the exhaust manifold 48. The converter can include multiple catalyst bricks, in one example. In another example, multiple emission control devices, each with multiple bricks, can be used. The converter may be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 may receive various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a knock sensor for determining ignition of end gases (not shown); a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In one aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition devices such as spark plug 92, resulting in combustion. Additionally or alternatively compression may be used to ignite the air/fuel mixture. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

FIG. 1 also shows a system 150 (e.g., piston cooling system). The system 150 includes an oil reservoir 152. The oil reservoir 152 may be an oil sump. The oil reservoir houses oil or other suitable lubricant. The oil reservoir 152 may be included in an engine lubrication system configured to flow oil to lubricated components within the engine 10. The lubricated components may include the crankshaft 40, cam bearings (not shown), piston 36, etc. Oil may be returned to the oil reservoir 152 from the engine lubrication system through return oil lines 163 and 169.

The engine 10 further includes an oil pump 154 including a pick-up tube 156 having an inlet in fluidic communication with the oil reservoir 152. The oil pump 154 is shown as being positioned within the oil reservoir. However, in other embodiments the oil pump 154 may be positioned external to the oil reservoir 152.

An outlet 158 of the oil pump 154 is in fluidic communication with a first loop 159. However, in other embodiments the oil pump may include a second outlet or a second oil pump may be included in the engine. The first loop may be included in an engine lubrication system. Additionally, the first loop 159 includes an oil line 160 in fluidic communication with the outlet 158 and lubricated engine components 161 (e.g., rotating engine components). The lubricated engine components 161 are generically depicted via a box. However, it will be appreciated that the lubricated engine components 161 may include the crankshaft 40, crankshaft bearings, cam bearings, etc. The lubricated engine components 161 may be spaced away from one another in the engine. In this way, the first loop provides oil or other suitable lubricant to lubricated components within the engine that bypasses a second loop (e.g., does not pass through the second loop 167, and thus is not cooled by a heat pipe 172). In this way, only the coolant used to cool the piston jets may be cooled via the heat pipe, enabling other engine components to be operated with warmer oil and thus operate with less friction. Therefore, a first portion of an outflow of the oil pump 154 is directed to the second loop 167 including the piston spraying conduit 162 and a second portion of the outflow of the oil pump 154 is directed to the first loop 159 including the lubricated engine components 161.

The heat pipe 172 is coupled to the piston spraying conduit 162 and cools the first portion of the outflow travelling through the piston spraying conduit. On the other hand, the second portion of the outflow of the oil pump 154 directed to the lubricated engine components 161 is not cooled via the heat pipe 172, in the depicted example. However, other heat pipe positions and loop configurations have been contemplated. For example, the heat pipe may cool the portion of the oil directed to the lubricated engine components, in some examples. The heat pipe 172 is discussed in greater detail herein.

In some examples, a water coolant to oil heat exchanger may not be included in first loop 159, if desired. As shown, a return oil line 163 is in fluidic communication with the lubricated engine components 161 and the oil reservoir 152. Although a single return oil line is depicted it will be appreciated that the first loop 159 may include a plurality of return oil lines.

The outlet 158 of the oil pump 154 is also in fluidic communication a second loop 167. The second loop 167 includes a piston spraying conduit 162. The second loop 167 is configured spray oil toward an underside of the piston 36 and flow the sprayed oil back to the oil reservoir 152. Therefore, drainage passage(s) and/or return line(s), denoted via arrow 169, may be configured to flow oil from the second loop 167 back to the oil reservoir 152. The piston spraying conduit 162 includes an oil distribution manifold 164 and a piston spraying branch 166. It will be appreciated that additional piston spraying branches may be included in the piston spraying conduit 162. The additional piston spraying branches may be configured to deliver an oil spray to other pistons in the engine and coupled to the oil distribution manifold 164. Arrows 165 denote the flow of oil from the oil distribution manifold to additional piston spraying conduits and nozzles (e.g., piston cooling jets). Thus, the additional piston spraying branches may have nozzles coupled thereto, each nozzle configured to aim an oil spray at a different piston, in some embodiments. However, in other embodiments, for each piston two or more nozzles may aim oil onto the underside of the piston. In one example, the system 150 may include a second nozzle, the second nozzle directing oil spray toward an exterior surface of a second piston positioned within a second combustion chamber.

The piston spraying branch 166 is directly coupled to the oil distribution manifold 164 in the depicted embodiment. However in other embodiments intermediary oil conduits may be included in the piston spraying conduit.

A nozzle 168 is directly coupled to an end of the piston spraying branch 166. The nozzle 168 is configured to aim or direct an oil spray onto or toward an exterior surface 170 of the piston 36. The exterior surface 170 is an underside of the piston 36, in the depicted example. The exterior surfaced 170 is not in face sharing contact with the combustion chamber walls 32 and does not define the boundary of the combustion chamber 30. The piston spraying branch 166 and the nozzle 168 may be referred to as a piston cooling jet.

The heat pipe 172 is coupled to the piston spraying conduit 162. The heat pipe 172 is positioned vertically below the combustion chamber 30. However, in other embodiment, at least a portion of the heat pipe 172 may be position above the combustion chamber 30. A vertically axis is provided for reference. An evaporator section 174, the section denoted via a dashed box, of the heat pipe 172 is positioned within the piston spraying branch 166, in the depicted embodiment. The evaporator section 174 extends down an interior region of the piston spraying branch 166 and includes a portion that is parallel to the central axis of the spraying branch. In this way, oil may be flowed around the housing of the evaporator section 174. As a result, a greater amount of heat may be transferred to the heat pipe 172 from the oil flowing through the piston spraying conduit 162. As shown, the heat pipe 172 extends through a housing of the piston spraying branch 166. The evaporator section also includes heat fins 175 extending from the housing. The heat fins are arranged perpendicular to the axis of the piston spraying branch 166. However, other heat fins arrangements have been contemplated. The heat fins are coupled to a housing of the evaporator section 174 and do not extend into the vapor cavity of the heat pipe 172 in the depicted embodiment. Therefore, oil may also be flowed around the heat fins. However, in other embodiments the heat fins may partially extend into the sealed cavity 202 of the heat pipe 172, shown in FIG. 2, and discussed in greater detail herein. In other embodiments, the housing of the evaporator section 174 or the heat fins 175 of the evaporator section may be coupled externally or internally to the housing of the piston spraying branch 166, other portions of the piston spraying conduit 162, such as the oil distribution manifold 164, or at another location downstream of the split between the first and second loops. It will be appreciated that in either of the aforementioned embodiments the evaporator section 174 is directly coupled to the piston spraying branch 166. Directly coupled includes that there are no intermediary components coupled between the components.

In some examples, the evaporator section 174 may be at least partially enclosed by the piston spraying conduit 162. In this way, oil may be flowed around an exterior surface of the evaporator section 174 enabling a greater amount of heat to be transferred to the heat pipe from the oil. However, in other examples the exterior surface of the evaporator section may be directly coupled to an external portion of the housing of the piston spraying conduit 162.

The heat pipe 172 further includes a condenser section 176 coupled to the evaporator section 174 via an intermediary section 178. The condenser section 176 includes heat fins 177. It will be appreciated that the condenser section 176 and the evaporator section 174 are positioned at opposing ends of the heat pipe 172. The condenser section 176 is configured to transfer heat from the working fluid in the heat pipe to the components and/or air surrounding the condenser section 176. Thus, heat may be removed from the heat pipe to enable the temperature of the working fluid to be reduced in order to return the working fluid to a liquid state from a gas state. A fan 190 may also be included in the system 150. The fan 190 is configured to direct air toward the condenser section 176, denoted via arrow 191. The fan 190 may also be configured to direct air toward a heat exchanger included in an engine cooling system in some embodiments. The engine cooling system may be configured to circulate coolant through the cylinder head 90 and/or cylinder block 91.

On the other hand, the evaporator section 174 is configured to transfer energy from the piston spraying conduit 162 to the working fluid in the heat pipe 172. Specifically, heat may be transferred from the oil flowing through the piston spraying conduit 162 to the working fluid in the heat pipe 172. In this way, heat may be removed from the oil directed toward the piston 36. This reduction in oil temperature enables a greater reduction in piston temperature and therefore combustion chamber temperature. As a result, an engine with a higher compression ratio may be used if desired, increasing the engine's power output. In some examples, the compression ratio of the combustion chamber 30 may be greater than {10, as previously discussed. Moreover, the reduction in combustion chamber temperature also enables a more aggressive spark timing strategies to be used in engine if desired, further increasing the engine's power output. The spark timing strategy is discussed in greater detail herein.

During operation of the heat pipe 172, when the piston spraying conduit 162 and specifically, the oil in the piston spraying conduit is over a threshold temperature, heat may be transferred to the evaporator section 174, where a portion of the working fluid may then change to a vapor. The vapor may then flow down the length of the heat pipe through the intermediary section 178. Subsequently, the vapor may reach the condenser section 176. In the condenser section 176 the vapor condenses back into fluid. The fluid may then flow back toward the evaporator section 174. In some embodiments, the working fluid may flow through a wicking material, discussed in greater detail herein with regard to FIG. 2. Subsequently the working fluid may reach the evaporator section 174. It will be appreciated that the aforementioned cycle may repeat. In this way, heat is passively transferred away from piston spraying conduit 162 or other component in the system 150. The working fluid in the heat pipe 172 may include water, alcohol, and/or sodium. However, in some embodiments the working fluid may be solely water. The working fluid may be selected based on a desired working temperature range.

The condenser section 176 is positioned above the crankshaft 40 in the depicted embodiment. However, other condenser section locations have been contemplated. For example, the condenser section 176 may be positioned below the crankshaft 40. In the depicted embodiment, the evaporator section 174 is positioned vertically below the condenser section 176. However in other embodiments, the evaporator section 174 may be positioned vertically above the condenser section 176 or the evaporator section and the condenser section may be positioned at the same vertical height. Further, in some embodiments, the heat pipe 172 may extend through the cylinder block 91 and the condenser section 176 may be positioned outside of the cylinder block 91. The condenser section may be positioned in an area of the engine or vehicle which receives a large amount of ambient airflow. In this way, the amount of heat removed via the heat pipe may be increased. In some examples, the condenser section 176 may be coupled to a peripheral surface 179 of the engine. Specifically, in some embodiments the condenser section 176 may be positioned in the front of engine compartment, behind a cooling fan where there is a desirable amount of airflow.

Controller 12 may be configured to send an ignition timing signal to the ignition system 88. The spark timing provided to the ignition system 88 by the controller 12 may be adjusted based on the temperature of the oil spray from the nozzle 168. Specifically, the spark timing may be advanced or retarded based on the temperature of the oil spray and/or the cylinder temperature. Therefore, the controller 12 may be configured to send a first ignition signal to the ignition device during a first operating condition and a second ignition signal to the ignition device during a second operating condition, the second ignition signal varying from the first ignition signal by at least 0.01 seconds, in one example. In some examples, the temperature of the oil spray may be calculated. For instance, the temperature of the oil spray may be calculated based on the characteristics of the heat pipe 172 such as the heat pipe's diameter, length, heat transfer characteristics, material construction, etc. In other examples, a temperature sensor may be coupled to the nozzle 168 or the piston spraying conduit 162 downstream of the evaporator section 174 to provide a temperature signal.

Figure 2:
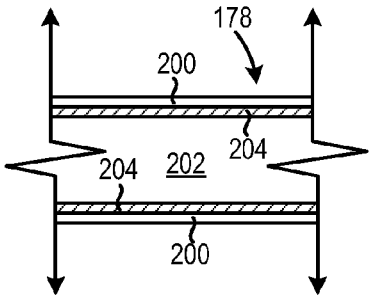
FIG. 2 shows a cross-sectional view of the heat pipe shown in FIG. 1.

FIG. 2 shows a cross-sectional view of a portion of the heat pipe 172 shown in FIG. 1. Specifically, a cross-section of the intermediary section 178 is depicted. The heat pipe 172 includes a housing 200. The housing 200 is sealed. That is to say that the materials, liquid, gas, etc., enclosed within the heat pipe 172 is not in fluidic communication with the surrounding environment. The housing 200 encloses a sealed cavity 202 (e.g., vapor cavity) traversing the length of the heat pipe 172 from the condenser section 176 to the evaporator section 174, shown in FIG. 1. The heat pipe 172 further includes a wicking material 204 traversing at least a portion of an inner periphery of the housing 200, in the depicted embodiment. However, in other embodiments the heat pipe 172 may not include the wicking material. For example, when the condenser section is positioned vertically above the evaporator section wicking material may not be used, if desired. The wicking material may be configured to flow the working fluid from the condenser section 176 to the evaporator section 174, shown in FIG. 1. A working fluid may be in the sealed cavity 202 and the wicking material 204.

Figure 3:
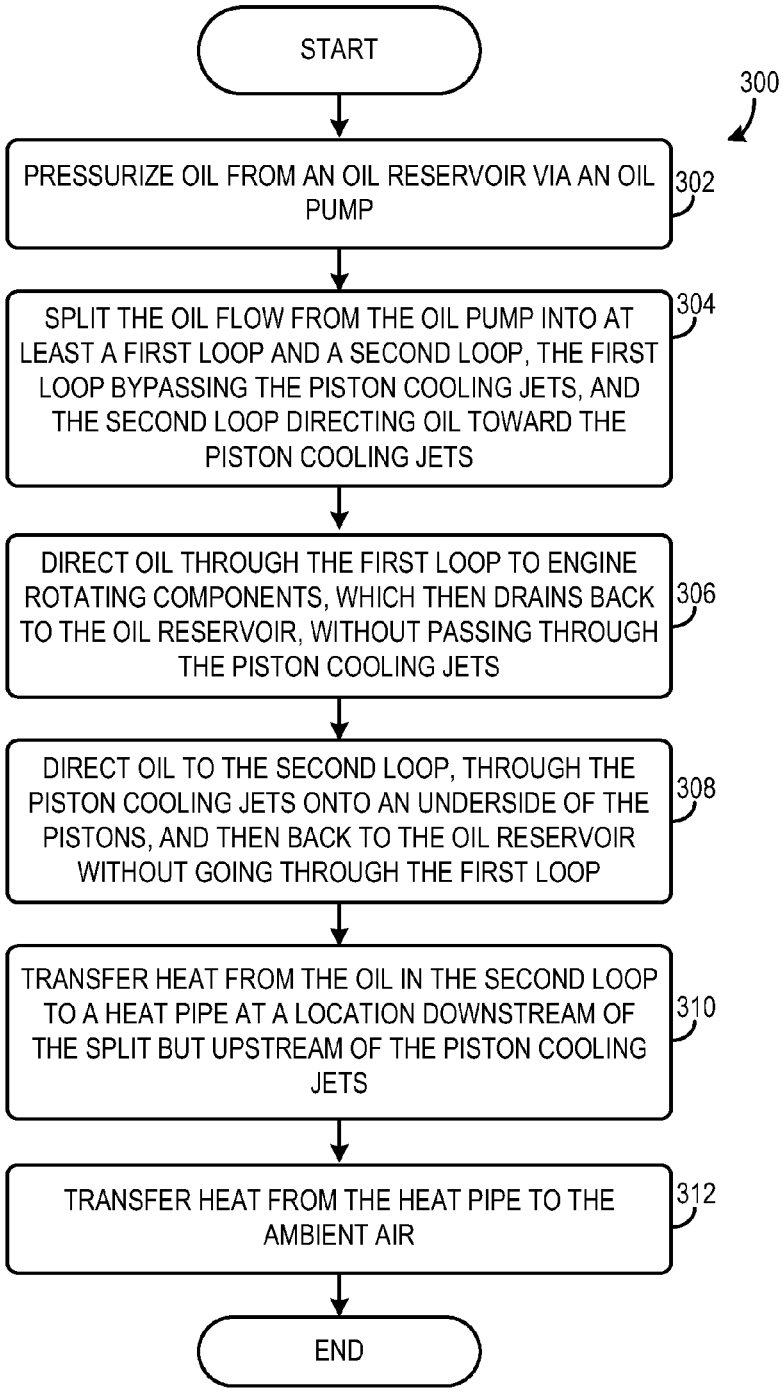
FIG. 3 shows a method for operation of an engine.

FIG. 3 shows a method 300 for operation of a system 150. The method 300 may be implemented via the engine, systems, and components described above with regard to FIGS. 1-2 or may be implemented by other suitable engines, systems, and components.

At 302 pressurizing oil from an oil reservoir via an oil pump. Next at 304 the method includes splitting the oil flow from the oil pump into at least a first loop and a second loop, the first loop bypassing the piston cooling jets, and the second loop directing oil toward the piston cooling jets.

At 306 the method includes directing oil through the first loop to engine rotating components, which then drains back to the oil reservoir, without passing through the piston cooling jets, and at 308 directing oil to the second loop, through the piston cooling jets onto an underside of the pistons, and then back to the oil reservoir without going through the first loop. It will be appreciated that the first and second loops are mutually exclusive.

Next at 310 the method includes transferring heat from the oil in the second loop to a heat pipe at a location downstream of the split but upstream of the piston cooling jets. At 312 the method includes transferring heat from the heat pipe to the ambient air. In this way, a heat pipe may be used to cool the oil delivered to the piston spraying jets without cooling the oil delivered to the engine rotating components.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system in an engine comprising:

a piston spraying conduit including an inlet in fluidic communication with an oil reservoir;

a nozzle in fluidic communication with the piston spraying conduit, the nozzle directing an oil spray toward an exterior surface of a piston positioned within a combustion chamber; and a heat pipe transferring heat from an evaporator section to a condenser section, the evaporator section coupled to the piston spraying conduit.

2. The system of claim 1, where evaporator section is at least partially enclosed by the piston spraying conduit.

3. The system of claim 1, where the heat pipe is positioned vertically below the combustion chamber.

4. The system of claim 1, where the evaporator section is coupled to the piston spraying conduit upstream of an oil distribution manifold in fluidic communication with a second nozzle, the second nozzle directing oil spray toward an exterior surface of a second piston positioned within a second combustion chamber.

5. The system of claim 1, where the condenser section is positioned below a crankshaft coupled to the piston.

6. The system of claim 1, where the piston spraying conduit is in fluidic communication with an engine lubrication conduit included in an engine lubrication system.

7. The system of claim 6, where the engine lubrication system does not include a water coolant to oil heat exchanger.

8. The system of claim 1, where the condenser section is positioned vertically above the evaporator section.

9. The system of claim 8, where the heat pipe does not include a wicking material.

10. The system of claim 1, where the heat pipe includes a wicking material.

11. The system of claim 1, where the condenser section is coupled to a peripheral surface of the engine.

12. A system in an engine comprising:

a piston spraying conduit including an inlet in fluidic communication with an oil reservoir in fluidic communication with an engine lubrication system providing engine oil to lubricated components in the engine;

a nozzle in fluidic communication with the piston spraying conduit, the nozzle aiming an oil spray toward an exterior surface of a piston positioned within a combustion chamber; and a heat pipe transferring heat from an evaporator section to a condenser section, the evaporator section coupled to the piston spraying conduit.

13. The system of claim 12, where combustion chamber having a compression ratio of between 9 and 12.

14. The system of claim 12, further comprising an ignition device positioned within the combustion chamber and a controller configured to send a first ignition signal to the ignition device during a first operating condition and a second ignition signal to the ignition device during a second operating condition, the second ignition signal varying from the first ignition signal by at least 0.01 seconds.

15. The system of claim 12, where the engine lubrication system does not include a heat exchanger, and where engine oil provided to the engine lubrication system bypasses the heat pipe.

16. The system of claim 12, where the condenser section is coupled to a peripheral surface of the engine.

17. A system in an engine comprising:

a piston spraying conduit including an inlet in fluidic communication with an oil reservoir in fluidic communication with an engine lubrication system providing engine oil to lubricated components in the engine;

a nozzle in fluidic communication with the piston spraying conduit, the nozzle aiming an oil spray toward an exterior surface of a piston positioned within a combustion chamber; and a heat pipe transferring heat from an evaporator section to a condenser section, the evaporator section directly coupled to the piston spraying conduit.

18. The system of claim 17, where the piston spraying conduit is positioned downstream of an oil pump, the oil pump in fluidic communication with an engine lubrication system providing oil to lubricated components in the engine.

19. The system of claim 18, where a first portion of an outflow of the oil pump is directed to the piston spraying conduit and cooled by the heat pipe and a second portion of the outflow of the oil pump is directed to the lubricated components in the engine and not cooled by the heat pipe.

20. The system of claim 17, where the heat pipe extends through a cylinder block, the cylinder block forming a portion of the combustion chamber.

21. The system of claim 20, where the cylinder block is coupled to the oil reservoir, the cylinder block and the oil reservoir at least partially surrounding the heat pipe.

* * * * *